US005946934A

United States Patent [19]

Kim et al.

[11] Patent Number: 5,946,934

[45] Date of Patent: Sep. 7, 1999

[54] COOL AIR SUPPLYING SYSTEM FOR REFRIGERATORS

[75] Inventors: Seok Ro Kim; Sung Hong Kang, both of Kyungnan, Rep. of Korea

[73] Assignee: LG Electronics, Inc., Seoul, Rep. of Korea

[21] Appl. No.: 09/084,796

[22] Filed: May 27, 1998

[30] Foreign Application Priority Data

| | | | |
|---|---|---|---|
| May 27, 1997 | [KR] | Rep. of Korea | 97-20912 |
| May 27, 1997 | [KR] | Rep. of Korea | 97-20913 |
| Jun. 12, 1997 | [KR] | Rep. of Korea | 97-24374 |
| Jun. 12, 1997 | [KR] | Rep. of Korea | 97-24376 |
| Jun. 12, 1997 | [KR] | Rep. of Korea | 97-24377 |

[51] Int. Cl.[6] ..... F25D 17/04

[52] U.S. Cl. ..... 62/408; 62/187

[58] Field of Search ..... 62/407, 408, 187, 62/441

[56] References Cited

U.S. PATENT DOCUMENTS

| | | | |
|---|---|---|---|
| 2,562,057 | 7/1951 | Norberg et al. | 62/408 |
| 3,025,683 | 3/1962 | Baker et al. | 62/408 |
| 4,161,868 | 7/1979 | Kennedy et al. | 62/256 |
| 4,276,754 | 7/1981 | Ty | 62/187 |
| 4,920,758 | 5/1990 | Janke et al. | 62/187 |
| 5,584,191 | 12/1996 | Kwon | 62/417 |

FOREIGN PATENT DOCUMENTS

| | | | |
|---|---|---|---|
| 402103362 | 4/1990 | Japan | 62/187 |

*Primary Examiner*—William Doerrler

[57] ABSTRACT

A cool air supply system for refrigerators, capable of guiding cool air from the freezer compartment of a refrigerator to the refrigeration compartment door, wherein the cool air supply system includes a distributing duct, designed for guiding cool air circulated through a freezer compartment to a refrigeration compartment door< and a door duct disposed in the door where it can be selectively connected to the distribution duct. The distribution duct has a return duct designed for introducing the cool air to an evaporator and a branch duct which diverges from the return duct. Thus, the cool air, introduced into the door duct from the distribution duct and branch duct is readily discharged from the door to the inside of the refrigeration compartment.

20 Claims, 7 Drawing Sheets

COOL AIR SUPPLYING SYSTEM FOR REFRIGERATORS

BACKGROUND OF THE INVENTION

1. Field of the Invention

The present invention relates, in general, to a cool air supply system for refrigerators and, more particularly, to a cool air supply system capable of guiding cool air from the freezer compartment of a refrigerator to the refrigeration compartment door, thus allowing the cool air to be discharged from the door into the refrigeration compartment for rendering the inner temperature of the refrigeration compartment uniform.

2. Description of the Prior Art

FIGS. 1 and 2 are views illustrating the construction of a typical refrigerator.

As shown in the drawings, the typical refrigerator 1 is divided into two compartments, i.e. the freezer and refrigeration compartments 2 and 4, by a barrier 5 filled with an insulating material. The freezer and refrigeration compartments 2 and 4 are provided with doors 2*d* and 4*d*, respectively. In addition, a plurality of, preferably, four baskets 14 are mounted to the inner wall of the refrigeration compartment door 4*d* in a multistage manner.

The cool air circulation of the above refrigerator will be described below.

As shown in FIG. 2, a liquid refrigerant, having low temperature and low pressure, is quickly vaporized in the evaporator 6 while absorbing heat from air in the interior of the refrigerator 1, thus forming cool air to be circulated in the refrigerator 1. The cool air is partially discharged by a blower fan 8 into the freezer compartment 2 passing through a shroud 12. At this time, the remaining cool air is discharged into the refrigeration compartment 4 through a refrigeration duct 10. That is, the cool air primarily and freely flows down into the refrigeration duct 10. Thereafter, the cool air is discharged into the refrigeration compartment 4 through a plurality of discharging holes 10*a* which are formed on the front portion of the refrigeration duct 10.

After a time, the cool air, supplied to both the freezer and refrigeration compartments 2 and 4, develops a warmer temperature. That is, the low temperature of the cool air is transmitted to food and drink in the freezer and refrigeration compartments 2 and 4, thus forming warm air in both compartment 2 and 4, respectively. Such warm air is introduced to the evaporator 6 through first and second return ducts 2*a* and 4*a*, which are provided in the barrier 5.

However, the typical refrigerator is problematic in that it is somewhat difficult for the cool air to evenly circulate in the refrigeration compartment having a large volume as compared with the freezer compartment having a small volume.

In a brief description, the cool air is only discharged from the refrigeration duct 10 to the refrigeration compartment 4 through the discharging holes 10*a*. As a result, the temperature of the inside portion of the refrigeration compartment 4 is higher than that of a portion around the door of the refrigeration compartment 4. Particularly, when the door 4*d* of the refrigeration compartment 4 is repeatedly opened and closed, the temperature around the door portion of the refrigeration compartment 4 rises because hot air is introduced from the surroundings into the refrigeration compartment 4. Therefore, it is difficult for the refrigerator to maintain the freshness of the food and drink in the baskets 14.

SUMMARY OF THE INVENTION

Accordingly, the present invention has been made keeping in mind the above problems occurring in the prior art, and an object of the present invention is to provide a cool air supplying system for refrigerators capable of rendering the inner temperature of a refrigeration compartment more uniform.

Another object of the present invention is to provide a cool air supplying system for refrigerators capable of effectively supplying cool air to a refrigeration compartment door.

A further object of the present invention is to provide a cool air supplying system for refrigerators capable of effectively supplying cool air to a refrigeration compartment door.

Yet another object of the present invention is to provide a cool air supplying system for refrigerators having a case capable of quickly refrigerating stored goods therein and mounted to a refrigeration compartment door.

Still another object of the present invention is to provide a cool air supplying system for refrigerators capable of guiding cool air to a refrigeration compartment door and obtaining the usable space defined in the refrigeration compartment.

In order to accomplish the above objects, the present invention provides a cool air supplying system for refrigerators, comprising: a distributing duct designed for guiding cool air circulated through a freezer compartment to a refrigeration compartment door; and a door duct defined in the door in order to selectively connect to the distributing duct, so the cool air, introduced into the door duct passing through the distributing duct, is easily discharged from the door to an inside of the refrigeration compartment.

The distributing duct includes: a return duct designed for introducing the cool air, circulated through the refrigeration compartment, to an evaporator; and a branch duct diverged from the return duct, the branch duct being provided in a barrier formed between the freezer and refrigeration compartments in such a manner that its outlet extends to the front end of a refrigerator.

The distributing duct includes: a return duct designed for introducing the cool air, circulated through the refrigeration compartment, to an evaporator; and a branch duct diverged from the return duct, an outlet of the branch duct extends to the front end of the refrigerator passing through a side wall of the refrigeration compartment.

The distributing duct includes: a first door duct provided in a freezer compartment door; a second door duct provided in the refrigeration compartment door; and connecting means designed for communicating the first door duct with the second door duct.

The connecting means includes: a hinge member designed for rotatably supporting the freezer and refrigeration doors; and a hinge duct provided in the hinge member in order to communicate the first door duct with the second door duct.

The outlet of the second door duct is formed on an inner surface of the refrigeration compartment door, so the cool air is discharged into the inside of the refrigeration compartment and baskets of the refrigeration compartment door.

The cool air supplying system further comprises an adjusting means mounted to the branch duct at a desired position in order to adjust the cool air flowing through the door duct.

The cool air supplying system further comprises a sensing means mounted to the refrigeration compartment door in order to sense the inner temperature of the refrigeration compartment, so the adjusting means is operated by the sensing means.

The door duct is provided in the refrigeration compartment door in order to allow the cool air to be discharged into the inside of the refrigeration compartment and the baskets of the door.

The refrigeration compartment door is provided with a pocket in such a manner that the cool air is introduced into the pocket passing through the branch duct.

The pocket is provided with a refrigerating medium at a desired position in order to quickly refrigerate stored goods in the pocket.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

FIGS. 3 to 6 are views illustrating the construction of a refrigerator in accordance with the primary embodiment of the present invention.

Figure 1:
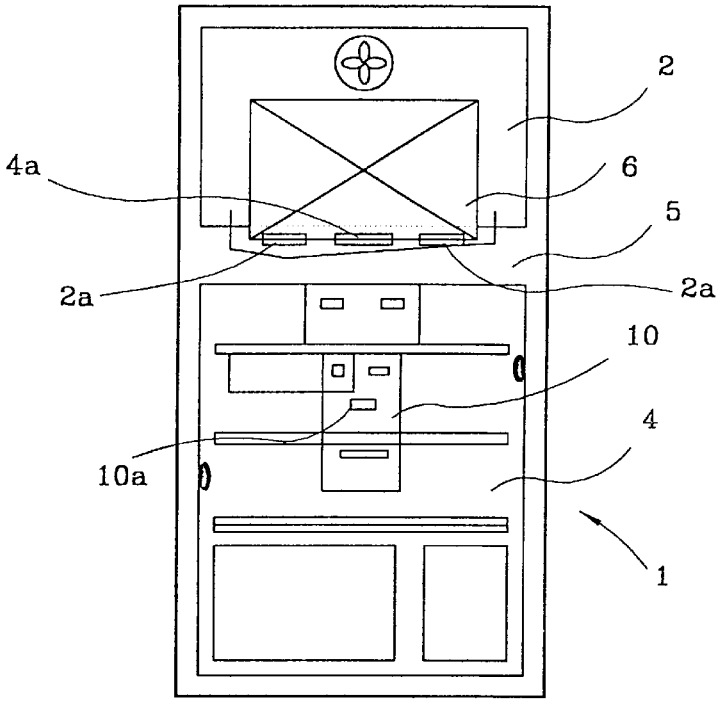
FIG. 1 CONVENTIONAL ART
FIG. 1 is a front view illustrating the construction of a typical refrigerator.
Figure 2:
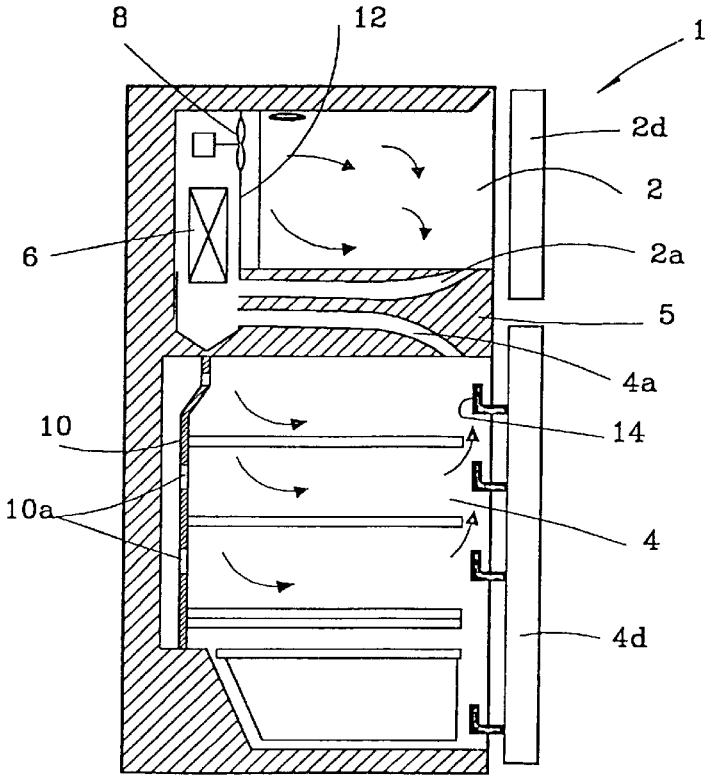
FIG. 2 CONVENTIONAL ART
FIG. 2 is a sectional side view showing the refrigerator of FIG. 1.
Figure 3:
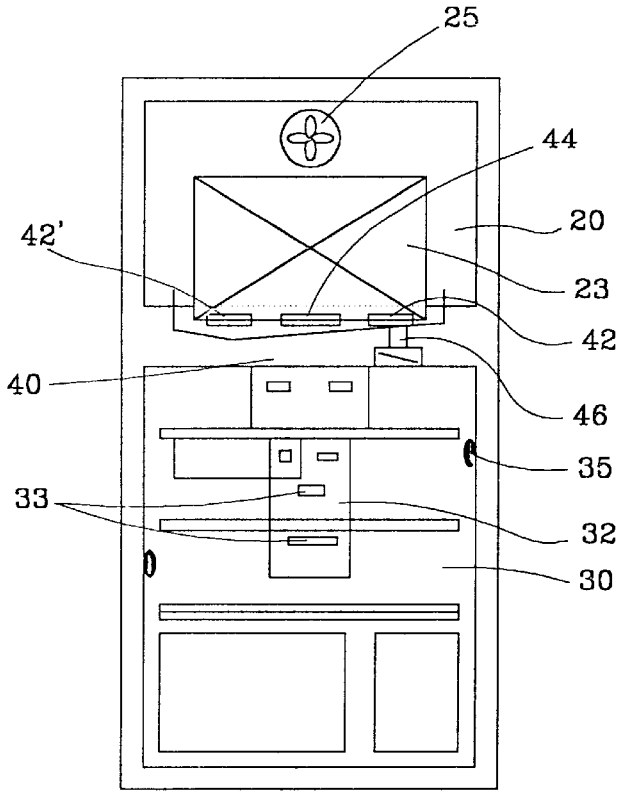
FIG. 3 is a front view illustrating the construction of a refrigerator in accordance with the primary embodiment of the present invention.
Figure 4:
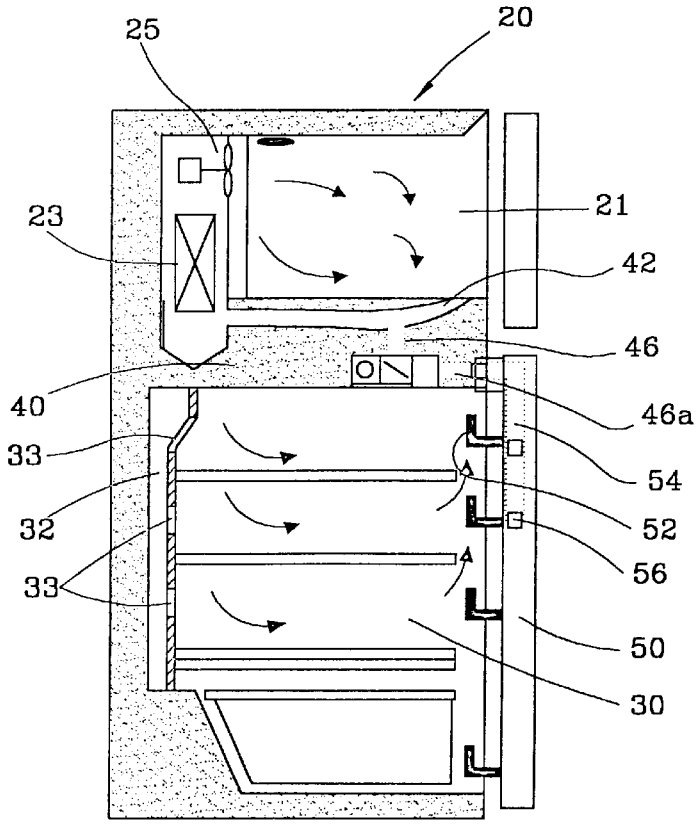
FIG. 4 is a sectional side view showing the refrigerator of FIG. 3.

As shown in FIGS. 3 and 4, the refrigerator 20 is divided into two compartments, i.e., freezer and refrigeration compartments 21 and 30, by a barrier 40 filled with an insulating material. In addition, a blower fan 25 is rotatably mounted to the rear end of the freezer compartment 21, while an evaporator 23 is mounted beneath the blower fan 25. Thus, cool air, formed around the evaporator 23, is easily discharged into the freezer compartment 21 by the blower fan 25. Also, return ducts 42, 42' and 44 are provided in the barrier 40 in order to introduce the cool air, circulated through the freezer and refrigeration compartments 21 and 30, to the evaporator 23. In this case, the return duct 44, designed for introducing the cool air circulated through the freezer compartment 21, is horizontally mounted between the return ducts 42 and 42', designed for introducing the cool air circulated through the refrigeration compartment 23.

A refrigeration duct 32 is mounted on the rear end of the refrigeration compartment 30 in order to introduce the cool air formed around the evaporator 23 into the refrigeration compartment 30. In addition, a plurality of discharge holes 33 are formed on the refrigeration duct 32 at desired positions, so the cool air is discharged into the refrigeration compartment 30 through the holes 33 as shown by the arrow in FIG. 4.

As shown in FIG. 4, a branch duct 46 is also provided in the barrier 40. That is, one end of the branch duct 46 communicates with the return duct 42, while an outlet 46*a* of the branch duct 46 extends to the front end of the refrigerator 20.

In addition, an adjusting device 48, designed for adjusting the flow of the cool air, is mounted to the branch duct 46. Such an adjusting device 48 is operated by a temperature sensing device disposed around the baskets 52 of the door 50 (or the temperature in the refrigeration compartment 30 is made identical with a temperature around the baskets 52). That is, when the temperature around the baskets 52 of the door 50 is higher than the predetermined temperature, the branch duct 45 is opened by the adjusting device 48. On the contrary, when the temperature around the baskets 52 of the door 50 is lower than the predetermined temperature, the branch duct 46 is closed by the adjusting device 48.

The temperature around the baskets 52 of the door 50 is determined by a temperature sensor 35, which is directly mounted on the baskets 52. Alternatively, the temperature sensor 35 may be mounted to the refrigeration compartment 30 around the baskets 52 of the door 50.

Figure 6:
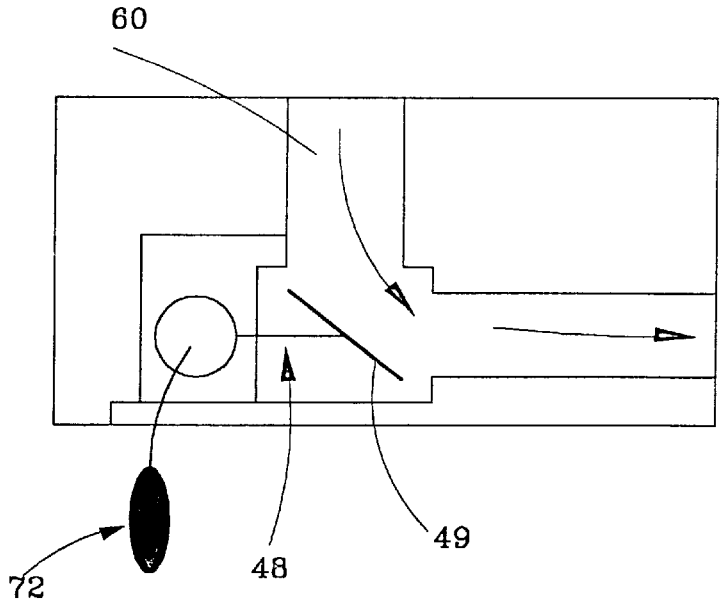
FIG. 6 is a sectional view illustrating an adjusting device of the refrigerator of FIG. 3.

It is possible to use a typical adjusting device in place of the above adjusting device 48. That is, the typical adjusting device can be manually operated, thereby preventing the cool air from flowing into the outlet 46*a* of the branch duct 46. Alternatively, the typical adjusting device may be automatically operated by the temperature sensor 35, thus allowing a rotatable plate 49 to be effectively operated as best shown in FIG. 6.

The door 50 is provided with a door duct 53 having an inlet 53*a* at a position corresponding to the outlet 46*a* of the branch duct 46. That is, when the door 50 is closed, the cool air, passing through the outlet 46*a* of the branch duct 46, is introduced into the door duct 53.

Figure 5:
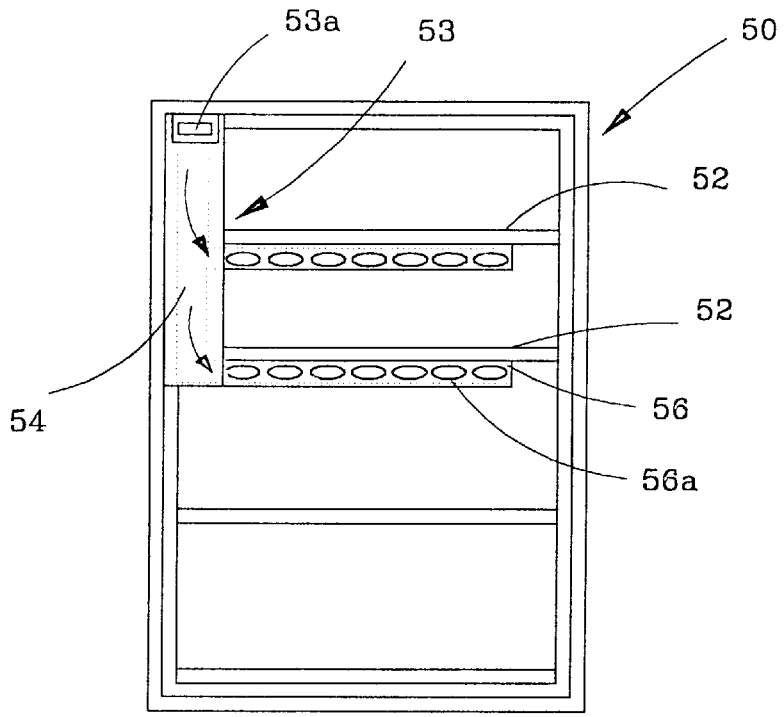
FIG. 5 is a front view illustrating a refrigeration compartment door of the refrigerator of FIG. 3.

As shown in FIG. 5, the door duct 53, mounted on the inner surface of the door 50, comprises a vertical duct 54 and a plurality of horizontal ducts 56. That is, the vertical duct 54 downwardly extends from the top end of the door 50 to a desired length, while the horizontal ducts 56 are horizontally diverged from the vertical duct 54 at a predetermined distance. Such horizontal ducts 56 are individually mounted beneath the baskets 52 of the door 50 and include a plurality of discharging holes 56*a*. Of course, it should be understood that the mounting method of the horizontal ducts 56 is not limited to the mounting method shown in FIG. 5 but may be freely changed without affecting the functioning of the present invention. That is, it is little worth consideration that the horizontal ducts 56 are horizontally mounted to the door 50 without regard to the mounting positions of the ducts 56. Preferably, the horizontal ducts 56 are individually provided in the baskets 52 of the door 50.

In the primary embodiment of the present invention, each of the horizontal ducts 56, mounted beneath the baskets 52, is provided with the discharging holes 56*a*. However, the forming method of the discharging holes 56*a* is not limit to the forming method of the discharging holes 56*a* as shown in FIG. 5. That is, the forming positions of the discharging holes 56*a* may be freely changed in order to allow the cool air to be discharged into the inside of the refrigeration compartment 30.

In this case, cool air is directly discharged to the food and drink in the baskets 52 through the discharging holes 56*a*, which are formed beneath the baskets 52 of the door 50, respectively. Alternatively, the discharging holes 56*a* may be formed in order to allow the cool air to be discharged from the door 50 to the inside of the refrigeration compartment 30.

The cool air circulation of the refrigerator in accordance with the primary embodiment of this invention is described below.

With reference to FIG. 4, a liquid refrigerant, having low temperature and low pressure, is quickly vaporized in the evaporator 23 while absorbing heat from air in the interior of the refrigerator 20, thus forming cool air to be circulated in the refrigerator 20. The cool air is discharged into the freezer and refrigeration compartments 21 and 30 by the blower fan 25.

In this case, the cool air, supplied into the freezer compartment 21, is introduced into the evaporator 23 through the return duct 44 after circulating through the freezer compartment 21. At this time, the cool air, supplied into the refrigeration compartment 30, is introduced into the evaporator 23 through the return ducts 42 and 42' after circulating through the refrigeration compartment 30. The circulated air has a low temperature due to the liquid refrigerant in the evaporator 23, thus again forming cool air to be circulated in the refrigerator 20. As a result, such cool air is repeatedly discharged into the freezer and refrigeration compartments 21 and 30 by the blower fan 25.

The cool air, introduced into the evaporator 23 through the return duct 42, is partially introduced into the branch duct 46. Thereafter, the cool air is controlled by the adjusting device 48, which is operated by the temperature sensor 35. That is, when the temperature, detected by the sensor 35, is higher than the predetermined temperature, the branch duct 45 is opened by the rotatable plate 49 of the adjusting device 48. Thus, the cool air in the freezer compartment 21 flows into the door duct 53 passing through the branch duct 46. On the contrary, when the temperature, detected by the sensor 35, is lower than the predetermined temperature, the branch duct 45 is closed by the rotatable plate 49 of the adjusting device 48. Therefore, the cool air in the freezer compartment 21 is not introduced into the door duct 53.

The cool air, introduced into the door duct 53 through the adjusting device 48, is discharged into the baskets 52 or the inside of the refrigeration compartment 30 passing through the vertical and horizontal ducts 54 and 56. That is, the cool air is discharged around the baskets 52 or the door 50 adjoining to the refrigeration compartment 30, thus effectively dropping a temperature formed around the baskets 52. It is possible to allow the cool air to be discharged around the baskets 52 because the temperature of cool air, introduced into the evaporator 23 after circulating through the freezer compartment 21, is less than that of the refrigeration compartment 30.

Figure 7:
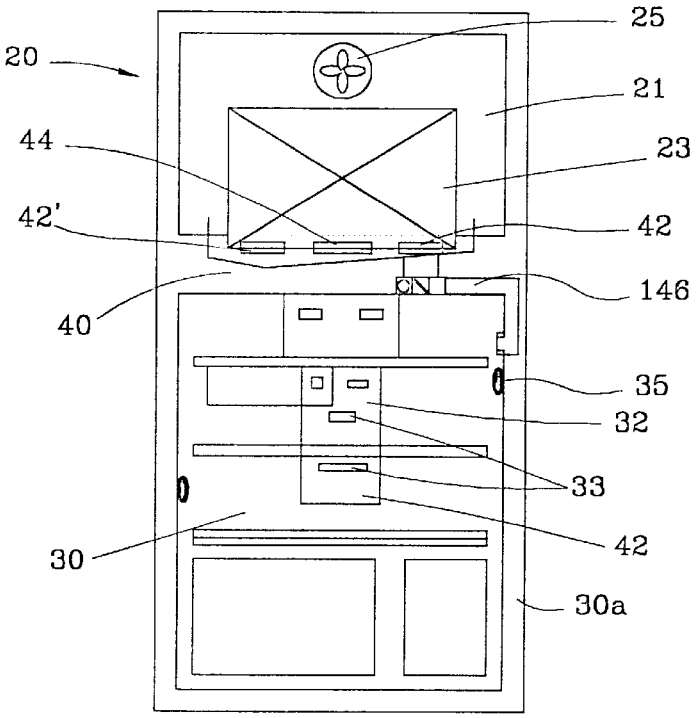
FIG. 7 is a front view illustrating the construction of a refrigerator in accordance with the second embodiment of the present invention.
Figure 8:
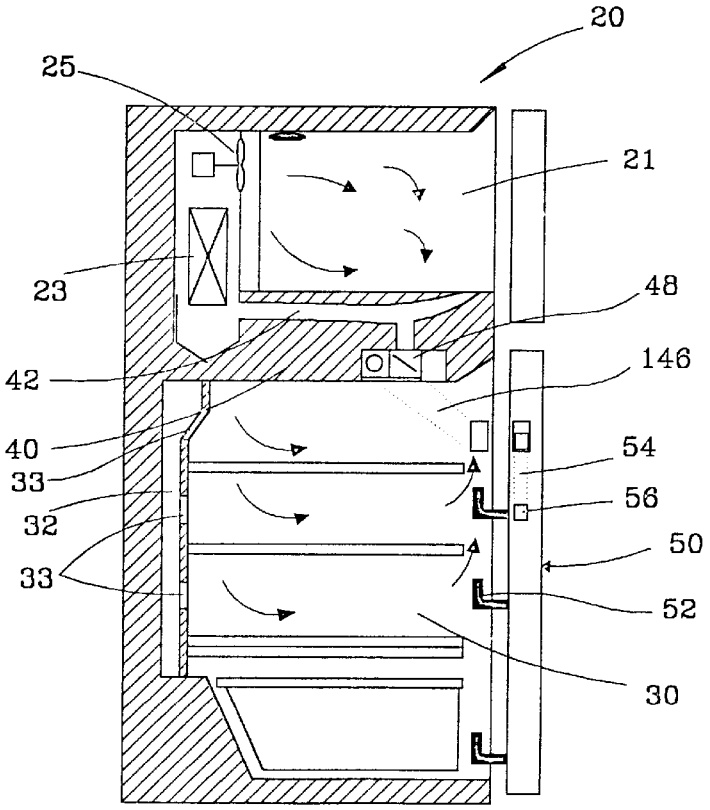
FIG. 8 is a sectional side view showing the refrigerator of FIG. 7.
Figure 9:
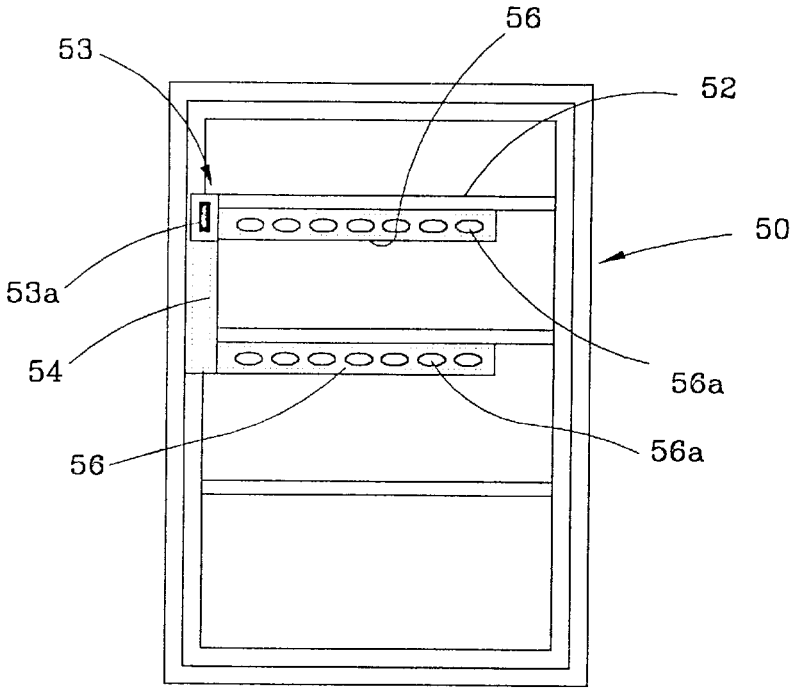
FIG. 9 is a front view illustrating a refrigeration compartment door of the refrigerator of FIG. 7.

FIGS. 7 to 9 are views illustrating the construction of a refrigerator in accordance with the second embodiment of the present invention.

In the second embodiment, a branch duct 146 is provided in the barrier 40. That is, one end of the branch duct 46 communicates with the return duct 42, while an outlet 146*a* of the branch duct 146 extends to the front end of the refrigerator 20 passing through one side wall 30*a* of the refrigeration compartment 30 as shown in FIGS. 7 and 8. The outlet 146*a* is preferably located at a position corresponding to the inlet 53*a* of the door duct 53.

The remaining members of the refrigerator are identical to the above-mentioned refrigerator illustrated in FIGS. 3 to 6. Thus, a description of the remaining members of the refrigerator is not deemed necessary.

The advantage of the branch duct 146, provided in one side wall 30*a* of the refrigeration compartment 30, is described below.

In a brief description, a styrofoam has to be filled into the barrier 40 so as to provide insulation to the barrier 40 prior to communicating the branch duct 146 to the barrier 40. Thus, it is difficult to mount the branch duct 146 in the barrier 40. However, in the second embodiment of this invention, the branch duct 146 is easily mounted in one side wall 30*a* of the refrigeration compartment 30. That is, the separated branch duct 146 can be mounted in the side wall 30*a* after filling the styrofoam into the barrier 40, thereby increasing the manufacturing efficiency of the refrigerator.

Also, the branch duct 146 is provided in the side wall 30*a* of the refrigeration compartment 30. Alternatively, the branch duct 146 may be protruded from the side wall 30*a*. Preferably, an insulating material is filled between the branch duct 146 and the side wall 30*a* of the refrigeration compartment 30.

The cool air circulation of the refrigerator is identical to that of the above-mentioned refrigerator illustrated in FIGS. 3 to 6. Thus, a description of the cool air circulation of the refrigerator is not deemed necessary.

Figure 10:
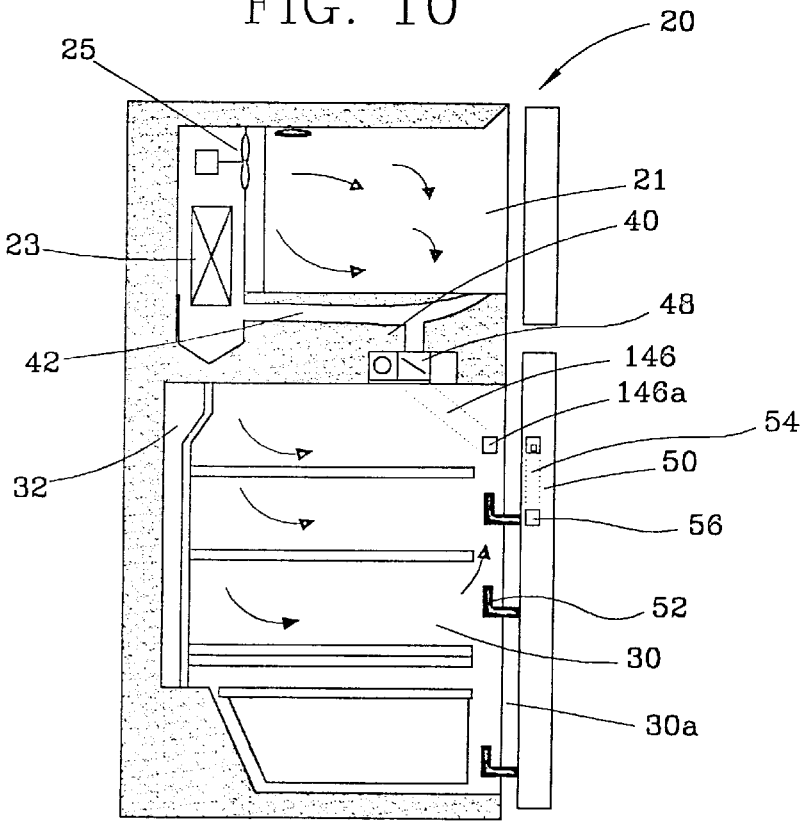
FIG. 10 is a section side view illustrating the construction of a refrigerator in accordance with the third embodiment of the present invention.
Figure 11:
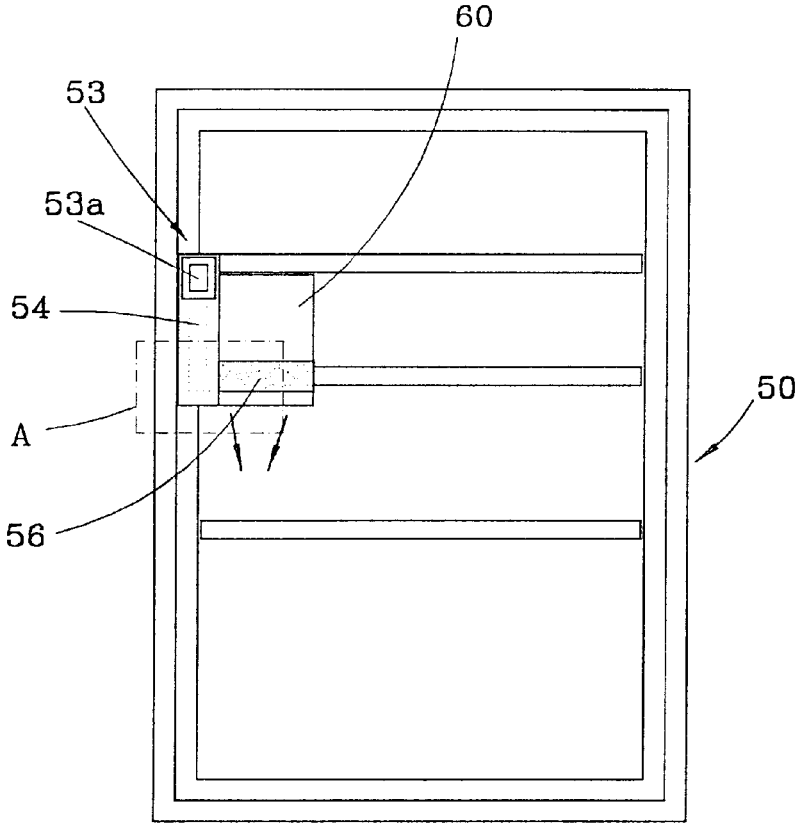
FIG. 11 is a front view illustrating a refrigeration compartment door of the refrigerator of FIG. 10.
Figure 12:
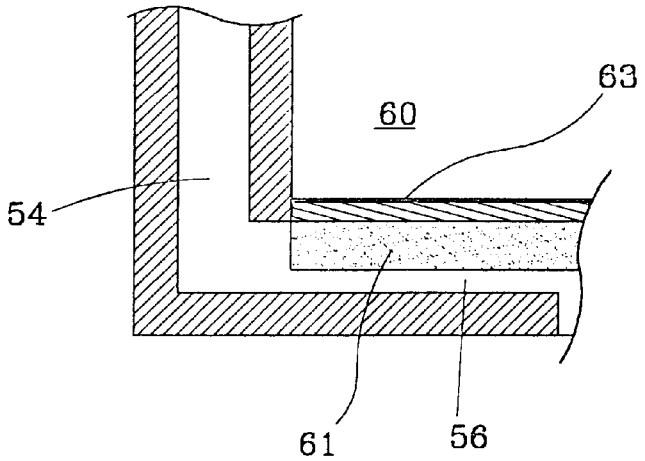
FIG. 12 is an expanded sectional view of "A" illustrated in FIG. 11.

FIGS. 10 to 12 are views illustrating the construction of a refrigerator in accordance with the third embodiment of the present invention.

In the third embodiment, a branch duct 146 is provided in the barrier 40. That is, one end of the branch duct 46 communicates with the return duct 42, while the other end of the branch duct 146 extends to the front end of the refrigerator 20. Alternatively, the other end of the branch duct 146 may extend to the front end of the refrigerator 20 passing through one side wall 30*a* of the refrigeration compartment 30. In addition, an adjusting device 48, designed for adjusting the flow of the cool air, is mounted to the branch duct 146. The adjusting device 48 is identical to the above-mentioned adjusting device illustrated in FIGS. 3 to 6. Thus, a description of the adjusting device is not deemed necessary.

The door 50 is provided with the door duct 53 having the inlet 53*a* at a position corresponding to an outlet 146*a* of the branch duct 146. The door duct 53 comprises a vertical duct 54, which downwardly extends from the inlet 53*a* of the door 50 to a desired length.

A separated pocket 60 has a box shape and is mounted on the inner surface of the door 50. Thus, stored goods in the separated pocket 60 are quickly cooled by the cool air, which flows through the vertical duct 54. The pocket 60 is provided with a refrigerating medium 61 at its lower end. A metal plate 63 has a high heat conductibility and is mounted on the bottom surface of the pocket 60. In this case, the metal plate 63 is an aluminum plate. The low temperature of the refrigerating medium 61 is made uniform at a desired temperature by the cool air flowing through the vertical duct 54 of the door duct 53, thus chilling the air in the refrigerating medium 61. As a result, the chilled air is conducted to the stored goods in the separated pocket 60 through the metal plate 63.

Also, it is possible to form the refrigerating medium 61 and the pocket 60 into a single body.

The door duct 53 comprises a horizontal duct 56, which is horizontally diverged from the vertical duct 54. A plurality of discharging holes (not shown), designed for allowing the cool air to be discharged into the refrigeration compartment 30, are formed on the vertical duct 54. The directions and positions of the discharging holes are identical to the above-mentioned discharging holes 56*a* illustrated in FIGS. 3 to 6. Thus, a description of the directions and positions of the discharging holes are not deemed necessary. As a result, the cool air, introduced to the horizontal duct 56 through the vertical duct 54 is discharged into the refrigeration compartment 30.

Alternatively, the cool air may be directly discharged from the vertical duct 54 to the inside of the pocket 60. In such a case, a plurality of holes are preferably formed on the pocket 60 in order to allow the cool air, introduced into the pocket 60, to be discharged into the refrigeration compartment 30.

In addition, it is possible to directly supply the cool air, flowing through the freezer and refrigeration compartments 21 and 30, to the pocket 60. That is, a branch duct is mounted to the upper portion of the refrigeration duct 32, thus allowing the cool air, flowing through the refrigeration compartment 30, to be partially discharged into the door duct 53.

The cool air circulation of the refrigerator in accordance with the third embodiment of this invention is described below.

In a brief description, the cool air, flowing to the evaporator 23 through the return duct 42 after circulating through the freezer compartment 21, is partially introduced into the branch duct 146. At this time, the adjusting device 48, mounted to the branch duct 146, is operated by the temperature sensor 35, which is mounted on the refrigeration compartment 30 (for example, the inside of the pocket 60). That is, when the temperature of the pocket 60 is higher than the predetermined temperature, the branch duct 146 is opened by the adjusting device 48. Thus, the cool air flows into the door duct 53 through the branch duct 146. Thereafter, the cool air partially flows to the horizontal duct 56 through the vertical duct 54 of the door duct 53, thus forming the chilled air in the refrigerating medium 61 as best shown in FIG. 12. As a result, the stored goods in the separated pocket 60 are quickly cooled by the chilled air.

Also, the remaining cool air is discharged into the baskets 52 and the refrigeration compartment 30 through the discharging holes (not shown) of the horizontal duct 56. Thereafter, the cool air, discharged from the refrigeration duct 32 and the door duct 53 to the refrigeration compartment 30, is circulated through the refrigeration compartment 30 and is introduced to the evaporator 23 through the return duct 44.

Figure 13:
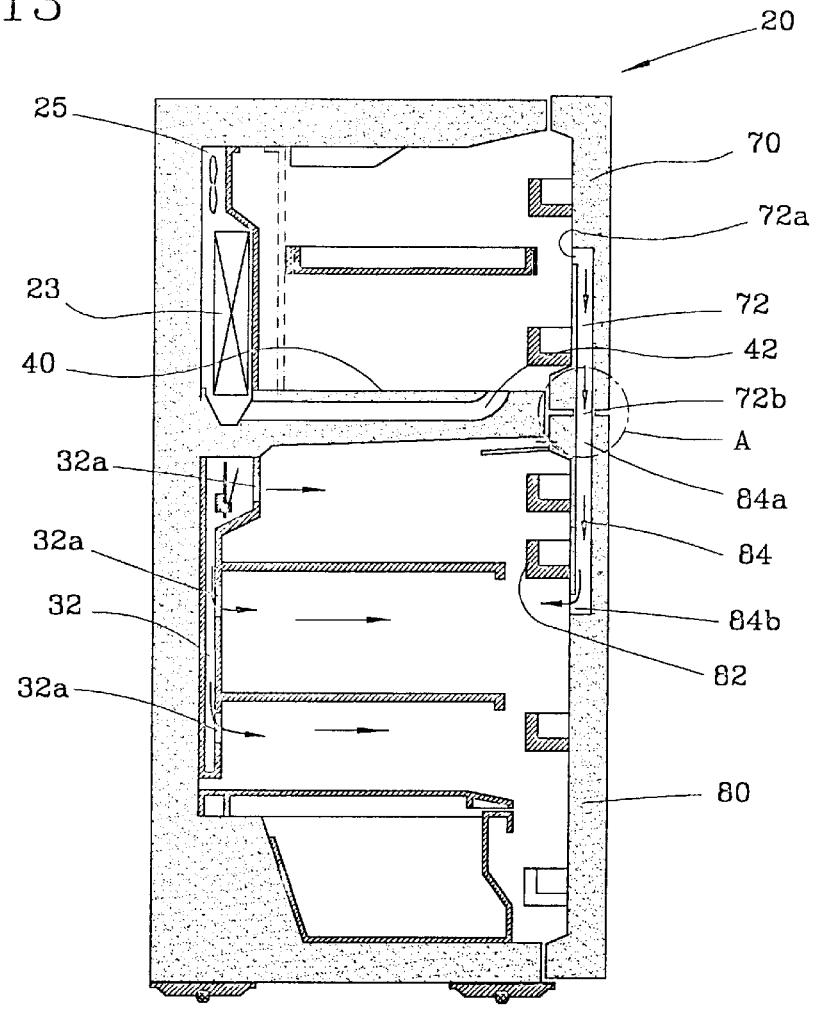
FIG. 13 is a section side view illustrating the construction of a refrigerator in accordance with the fourth embodiment of the present invention.
Figure 14:
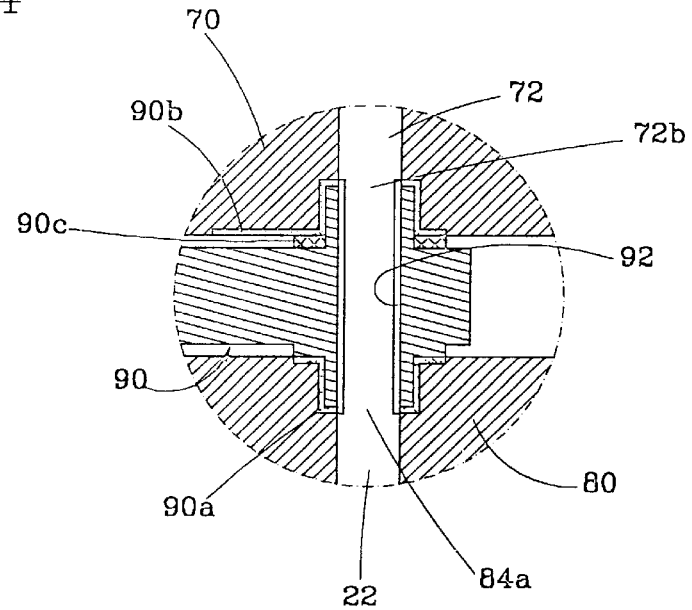
FIG. 14 is an expanded sectional view of "A" illustrated in FIG. 13.

FIGS. 13 to 14 are views illustrating the construction of a refrigerator in accordance with the fourth embodiment of the present invention.

In the fourth embodiment, the cool air in the freezer compartment 21 is partially discharged from a door 80 of the refrigeration compartment 30 to a baskets 82 and the inside of the refrigeration compartment 30 through a hinge member 90.

In a brief description, a first door duct 72 is provided in the door 70 of the freezer compartment 21. An inlet 72*a* of the first door duct 72 is formed on the inner surface of the door 70. Also, an outlet 72*b* of the first door duct 72 communicates with a hinge duct 92, which is provided in the hinge member 90.

The freezer and refrigeration compartment doors 70 and 80 rotatably support the hinge member 90. Such a hinge member 90 includes a washer 90*c* and two bushings 90*a* and 90*b*. The hinge duct 92 is provided in the hinge member 90 in order to allow the first door duct 72 to communicate with a second door duct 84 as shown in FIG. 14.

That is, the second door duct 84 is provided in the door 80 of the refrigeration compartment 30 and communicates with the first door duct 72. An inlet 84*a* of the second door duct 80 is connected to the hinge duct 92. Also, an outlet 84*b* of the second door duct 84 is formed on the inner surface of the door 80, thus allowing the cool air to be discharged into the baskets 82 and the inside of the refrigeration compartment 30. In the same manner as described for the horizontal duct, any duct instead of the horizontal duct may be mounted to the second door duct 84, thereby allowing the cool air to be uniformly discharged into the baskets 82 and the inside of the refrigeration compartment 30.

The remaining members of the refrigerator are identical to the above-mentioned refrigerator illustrated in FIGS. 3 to 6. Thus, a description of the remaining members of the refrigerator is not deemed necessary.

The cool air circulation of the refrigerator in accordance with the third embodiment of this invention is described below.

In a brief description, a liquid refrigerant, having low temperature and low pressure, is quickly vaporized in the evaporator 23 while absorbing heat from air in the interior of the refrigerator 20, thus forming cool air to be circulated in the refrigerator 20. The cool air is partially discharged into the freezer compartment 21 by the blower fan 25. At this time, the remaining cool air freely flows into the refrigeration duct 32. Thereafter, the cool air is discharged into the refrigeration compartment 30 through the discharging holes 32*a* of the refrigeration duct 32.

The cool air, supplied into the freezer compartment 21, is partially introduced to the first door duct 72 of the freezer door 70. Thereafter, the cool air is introduced to the second door duct 84 through the hinge duct 92 and is discharged into the refrigeration compartment 30 through the outlet 84*b* of the second door duct 84. As a result, the cool air flows from the front portion to the rear portion of the refrigeration compartment 30.

It is possible to carry out a three-dimensional cooling in the refrigeration compartment 30 by the cool air supplied through the refrigeration duct 32 and the second door duct 84.

The cool air, circulated through the refrigeration compartment 30, is introduced to the evaporator 23 through the return duct 44 in the barrier 40. In such a case, when the outlet 84*b* of the second door duct 84 is formed in order to allow the cool air to be introduced to the refrigeration compartment 30 through the baskets 82, the goods in the baskets 82 may be more freshly stored. In addition, the usable space defined in the refrigeration compartment 30 is effectively increased.

As mentioned above, the cool air supplying system for refrigerators of this invention guides the cool air in the freezer compartment to the refrigeration compartment door, thus allowing the cool air to be discharged from the refrigeration compartment door into the refrigeration compartment and uniforming the inner temperature of the refrigeration compartment.

In addition, even when the refrigeration compartment door is repeatedly opened and closed, the temperature balance in the refrigeration compartment is maintained by the cool air discharged from the baskets or the refrigeration compartment door.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cool air supply system for a refrigerator, comprising:

a distribution duct designed for guiding cool air circulated through a freezer compartment to a refrigeration compartment door said distribution duct including a return duct designed for introducing the cool air, circulated through said freezer compartment to an evaporator, a branch duct diverging from said return duct, said branch duct being provided in a barrier formed between the freezer and refrigeration compartments in such a manner that its outlet extends to the front end of the refrigerator, and a door duct disposed in the refrigeration compartment door for selectively communicating with said distribution duct, whereby the cool air introduced from said distribution duct into said door duct, is readily discharged from the refrigeration compartment door to the inside of the refrigeration compartment.

2. A cool air supply system for a refrigerator, comprising:

a distribution duct designed for guiding cool air circulated through a freezer compartment to a refrigeration compartment door, said distribution duct including:

a return duct designed for introducing the cool air, circulated through said freezer compartment, to an evaporator, a branch duct diverging from said return duct, one outlet of said branch duct extending to the front end of the refrigerator and passing through a side wall of said refrigeration compartment, and a door duct disposed in the refrigeration compartment door for selectively communicating with said distribution duct, whereby the cool air introduced from said distribution duct into said door duct, is readily discharged from the refrigeration compartment to the inside of the refrigeration compartment.

3. A cool air supply system for a refrigerator, comprising:

a distribution duct designed for guiding cool air circulated through a freezer compartment to a refrigeration compartment door, said distribution duct including:

a first door duct provided in a freezer compartment door; and a second door duct provided in the refrigeration compartment door and communicating with the first door duct through connecting means, and a door duct disposed in the refrigeration compartment door for selectively communicating with said distribution duct, whereby the cool air introduced from said distribution duct into said door duct, is readily discharged from the refrigeration compartment to the inside of the refrigeration compartment.

4. The cool air supply system as claimed in claim 3, wherein said connecting means includes:

a hinge member designed for rotatably supporting said freezer and refrigeration doors; and a hinge duct provided in said hinge member in order to provide communication between said first door duct and said second door duct.

5. The cool air supplying system as claimed in claim 1, further comprising:

adjusting means mounted to said branch duct at a desired position in order to adjust the cool air flowing through said door duct.

6. The cool air supply system as claimed in claim 5, further comprising:

sensing means mounted in said refrigeration compartment door in order to sense the inner temperature of said refrigeration compartment, said adjusting means being operated by said sensing means.

7. The cool air supplying system as claimed in claim 1, wherein said door duct is provided in said refrigeration compartment door in order to allow the cool air to be discharged into the inside of the refrigeration compartment and the baskets of the door.

8. The cool air supply system as claimed in claim 1, wherein said refrigeration compartment door is provided with a pocket and the cool air passes through said branch duct into said pocket.

9. The cool air supplying system as claimed in claim 8, wherein said pocket is provided with a refrigerating medium at a desired position in order to quickly refrigerate stored goods in said pocket.

10. The cool air supply system of claim 1, wherein a refrigeration duct is mounted in the rear end of the refrigeration compartment, said refrigeration duct communicating with the distribution duct for introducing cool air into the refrigeration compartment.

11. The cool air supply system of claim 3, wherein a refrigeration duct is mounted in the rear end of the refrigeration compartment, said refrigeration duct communicating with the distribution duct for introducing cool air into the refrigeration compartment.

12. A cool air supply system for a refrigerator comprising:

a freezer compartment and a refrigeration compartment, a distribution duct designed for guiding cool air form the freezer compartment to the refrigeration compartment, and a door duct disposed within a door of the refrigeration compartment for selectively communication with said distribution duct, whereby the cool air introduced form said distribution duct into the door duct is discharged from the refrigeration compartment door to the inside of the refrigeration compartment.

13. The cool air supply system of claim 12, wherein said distribution duct includes a return duct designed for introducing the cool air, circulated through said freezer compartment to an evaporator, and a branch duct diverging from said return duct, said branch duct being provided in a barrier formed between the freezer and refrigeration compartments in such a manner that its outlet extends to the front end of the refrigerator.

14. The cool air supply system of claim 13, further comprising adjusting means mounted to said branch duct at a desired position in order to adjust the cool air flowing through said door duct.

15. The cool air supply system as claimed in claim 14, further comprising:

sensing means mounted in said refrigeration compartment door in order to sense the inner temperature of said refrigeration compartment, said adjusting means being operated by said sensing means.

16. The cool air supply system as claimed in claim 12, wherein said door duct is provided in said refrigeration compartment door in order to allow the cool air to be discharged into the inside of the refrigeration compartment and the baskets of the door.

17. The cool air supply system as claimed in claim 12, wherein said refrigeration compartment door is provided with a pocket and the cool air passes through said branch duct into said pocket.

18. The cool air supply system as claimed in claim 17, wherein said pocket is provided with a refrigerating medium at a desired position in order to quickly refrigerate stored goods in said pocket.

19. A cool air supply system for a refrigerator comprising:

a freezer compartment having a freezer compartment door and a refrigeration compartment having a refrigeration compartment door, a first door duct provided in the freezer compartment door, a second door duct provided in the refrigeration compartment door, and connecting means providing communication between the first door duct and the second door duct, whereby cool air generated in the freezer compartment can be circulated through the first door duct and the second door duct into the refrigeration compartment.

20. The cool air supply system of claim 19, wherein said connecting means includes a hinge member designed for rotatably supporting said freezer and refrigeration doors; and a hinge duct provided in said hinge member in order to provide communication between said first door duct and said second door duct.

* * * * *